US007308956B2

(12) United States Patent
Wenzel et al.

(10) Patent No.: US 7,308,956 B2
(45) Date of Patent: Dec. 18, 2007

(54) METHOD OF SECURING A ROTARY CUTTER TO A BODY OF A DOWN HOLE TOOL AND A ROTARY CUTTER ASSEMBLY

(76) Inventors: William R. Wenzel, 1738 Kensit Place, Edmonton, Alberta (CA) T6L 6X7; Robert Wenzel, 6719-32 Avenue NW, Edmonton, Alberta (CA) T6K 1L8

( * ) Notice: Subject to any disclaimer, the term of this patent is extended or adjusted under 35 U.S.C. 154(b) by 204 days.

(21) Appl. No.: 11/230,362

(22) Filed: Sep. 20, 2005

(65) Prior Publication Data

US 2006/0278432 A1 Dec. 14, 2006

(30) Foreign Application Priority Data

Jun. 13, 2005 (CA) ..... 2510287

(51) Int. Cl.
*E21B 10/30* (2006.01)

(52) U.S. Cl. ..... 175/346; 175/347

(58) Field of Classification Search ..... 175/325.3, 175/325.7, 426, 427
See application file for complete search history.

(56) References Cited

U.S. PATENT DOCUMENTS 2,189,034 A * 2/1940 Harrington ..... 175/346
4,548,284 A * 10/1985 Shinn et al. ..... 175/346
6,213,229 B1 4/2001 Majkovic

FOREIGN PATENT DOCUMENTS

CA 2461082 9/2005

OTHER PUBLICATIONS

Sii Smith Services, 'Reamer—Drilling on Gauge (DOG®) Sub', available at http://www.siismithservices.com/b_products/product_page.asp?ID=30, at least as early as 2001.

* cited by examiner

*Primary Examiner*—William P Neuder
(74) *Attorney, Agent, or Firm*—Davis Bujold & Daniels, P.L.L.C.

(57) ABSTRACT

A rotary cutter assembly constructed in accordance with this method of securing a rotary cutter to a body has a cutter pocket with a first shoulder and a truncated second shoulder. A receptacle extends into the first shoulder. A first retainer retains a first axle end of the rotary cutter and engages the first shoulder to prevent axial movement in a first direction. A projection on the first retainer engages the receptacle to prevent removal of the first retainer radially from the cutter pocket. A second retainer retains a second axle end of the rotary cutter. The second retainer has a step down portion engaging the truncated second shoulder of the cutter pocket to prevent axial movement in a second direction. A locking ring overlies the truncated second shoulder and the step down portion of the second retainer to prevent removal of the second retainer radially from the cutter pocket.

6 Claims, 2 Drawing Sheets

METHOD OF SECURING A ROTARY CUTTER TO A BODY OF A DOWN HOLE TOOL AND A ROTARY CUTTER ASSEMBLY

FIELD OF THE INVENTION

The present invention relates to a method of securing a rotary cutter to a body of a down hole tool and a rotary cutter assembly fabricated in accordance with the teachings of the method.

BACKGROUND OF THE INVENTION

Canadian Patent Application 2,461,082 entitled "Drilling on gauge sub" was filed on Mar. 9, 2004. The '082 patent describes a housing with reamer cutters positioned in cavities around the housing. This tool has performed well. However, in one instance a customer continued to use the tool long past its scheduled servicing date and one of the reamer cutters was lost downhole.

SUMMARY OF THE INVENTION

According to one aspect of the present invention there is provided a method of securing a rotary cutter to a body. A first step involves forming in an exterior surface of the body a cutter pocket having a first shoulder oriented toward a first end of the body and a truncated second shoulder oriented toward a second end of the body. A second step involves forming one of at least one receptacle extending into the first shoulder or at least one projection projecting from the first shoulder. A third step involves forming a first retainer for retaining a first axle end of the rotary cutter. The first retainer engages the first shoulder of the cutter pocket to prevent axial movement in a first direction. An other of the at least one receptacle or the at least one projection is provided which is adapted to engages the at least one receptacle in or the at least one projection from the first shoulder to prevent removal of the first retainer radially from the cutter pocket. A fourth step involves forming a second retainer for retaining a second axle end of the rotary cutter. The second retainer has a step down portion engaging the truncated second shoulder of the cutter pocket to prevent axial movement in a second direction. A fifth step involves positioning a locking ring on the exterior surface of the body. The locking ring overlies the truncated second shoulder and the step down portion of the second retainer to prevent removal of the second retainer radially from the cutter pocket.

According to another aspect of the present invention there is provided a rotary cutter assembly which includes a tubular body having a first end defining a first coupling, a second end defining a second coupling, an exterior surface defining more than one cutter pocket, and an interior surface defining an interior bore. Each cutter pocket has a first shoulder oriented toward the first end of the body and a truncated second shoulder oriented toward the second end of the body There is at least one receptacle extending into the first shoulder or at least one projection projecting from the first shoulder. A rotary cutter is provided for each cutter pocket. Each rotary cutter has a first end oriented toward the first end of the body and a second end oriented toward the second end of the body. A first axle end protrudes from the first end and a second axle end protrudes from the second end of the rotary cutter. A first retainer retains the first axle end of the rotary cutter. The first retainer engages the first shoulder of the cutter pocket to prevent axial movement in a first direction. An other of the at least one receptacle or the at least one projection adapted to engages the at least one receptacle in or the at least one projection from the first shoulder to prevent removal of the first retainer radially from the cutter pocket. A second retainer retains the second axle end of the rotary cutter. The second retainer has a step down portion engaging the truncated second shoulder of the cutter pocket to prevent axial movement in a second direction. A locking ring engages the exterior surface of the body. The locking ring overlies the truncated second shoulder and the step down portion of the second retainer to prevent removal of the second retainer radially from the cutter pocket.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
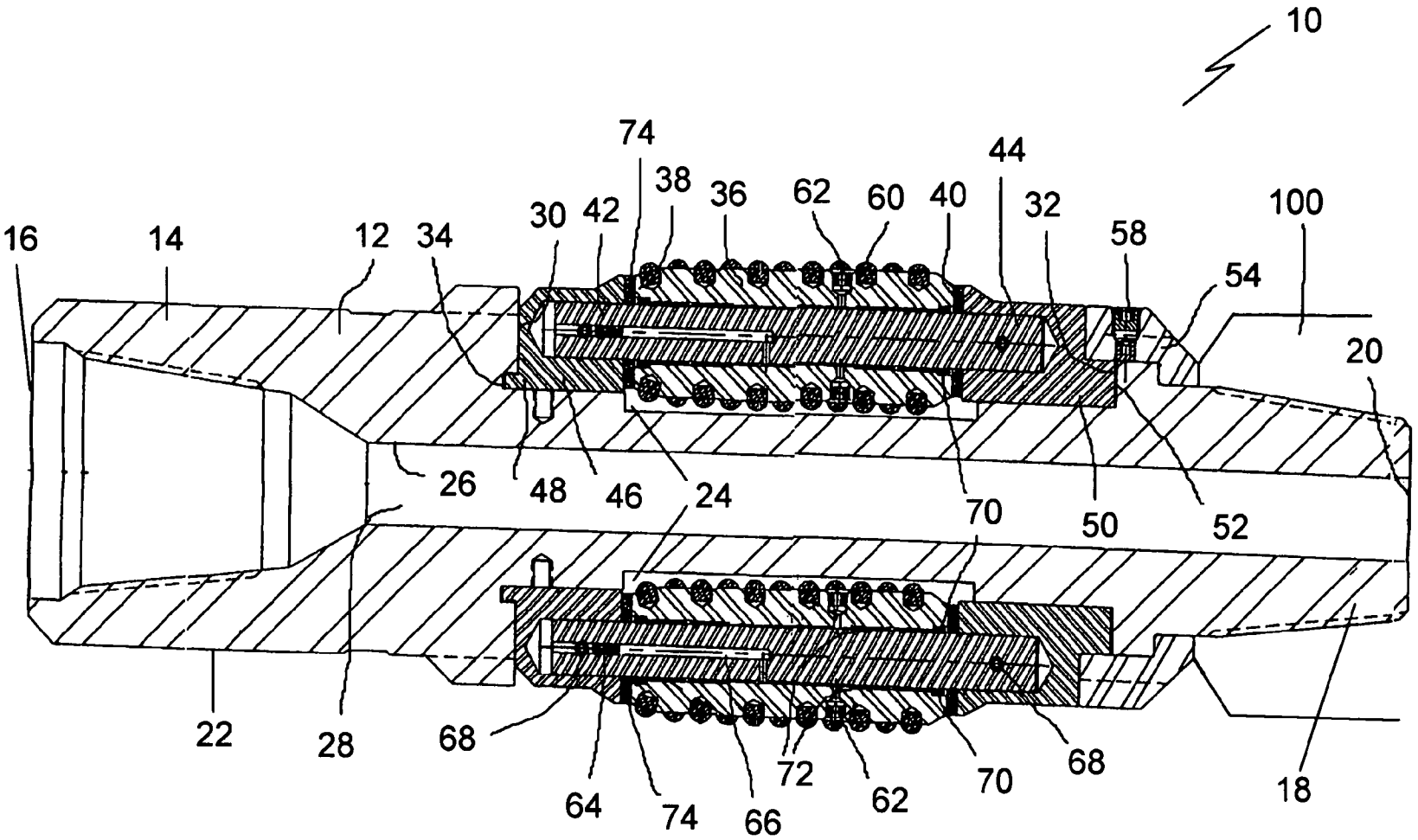
FIG. 1 is a side elevation view, in section, of a rotary cutter assembly constructed in accordance with the teachings of the present invention.

The preferred embodiment, a rotary cutter assembly generally identified by reference numeral 10, will now be described with reference to FIGS. 1 and 2.

Figure 2:
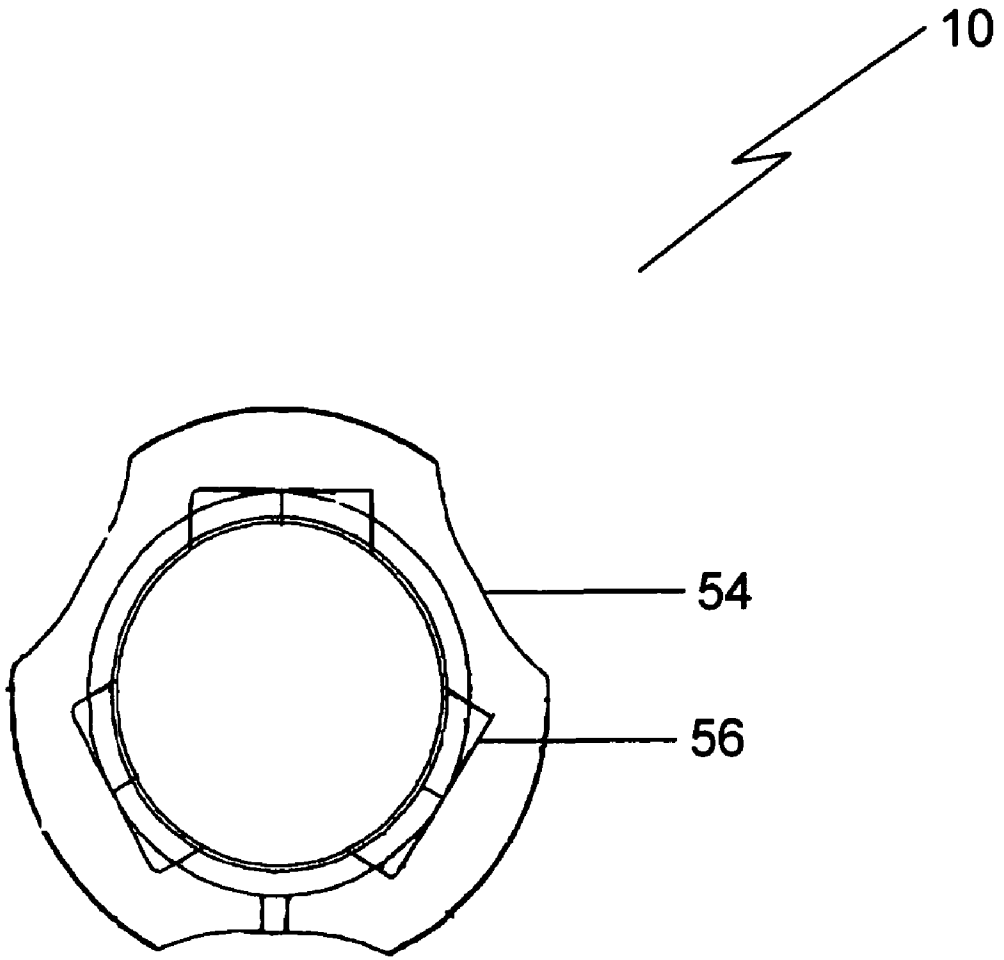
FIG. 2 is a end elevation view of a locking ring from the rotary cutter assembly illustrated in FIG. 1.

Structure and Relationship of Parts:

Referring to FIG. 1, rotary cutter assembly 10 has a tubular body 12 having a first end 14 defining a first or box connection coupling 16, a second end 18 defining a second or pin connection coupling 20, an exterior surface 22 defining more than one cutter pocket 24, and an interior surface 26 defining an interior bore 28. Each cutter pocket 24 has a first shoulder 30 oriented toward first end 14 of body 12 and a truncated second shoulder 32 oriented toward second end 18 of body 12. A groove form receptacle 34 extends into first shoulder 30. A rotary cutter 36 is provided for each cutter pocket 24. Each rotary cutter 36 has a first end 38 oriented toward first end 14 of body 12 and a second end 40 oriented toward second end 18 of body 12. A first axle end 42 protrudes from first end 38 and a second axle end 44 protrudes from second end 40 of rotary cutter 36. A first retainer 46 retains first axle end 42 of rotary cutter 36. First retainer 46 engages first shoulder 30 of cutter pocket 24 to prevent axial movement of first retainer 46 in a first direction toward first end 14 of body 12. First retainer 46 has a tongue-like projection 48 adapted to engage receptacle 34 in first shoulder 30 to prevent removal of first retainer 46 radially from cutter pocket 24. A second retainer 50 retains second axle end 44 of rotary cutter 36. Second retainer 50 has a step down portion 52 which engages truncated second shoulder 32 of cutter pocket 24 to prevent axial movement in a second direction toward second end 18 of body 12. A locking ring 54 engages exterior surface 22 of body 12. Locking ring 54 overlies truncated second shoulder 32 and step down portion 52 of second retainer 50 to prevent removal of second retainer 50 radially from cutter pocket 24. Referring to FIG. 2, locking ring 54 has pockets 56 which accommodate truncated second shoulders 32. An engagement between truncated second shoulders 32 and pockets 56 serves as a clutch style engagement which prevents rotation of locking ring 54. Referring to FIG. 1, it is preferred that locking ring 54 overlie pin connection coupling 20. Pin connection coupling 20 is intended for use in securing body 12 to a drill string of tubular members connected in end to end relation. As will hereinafter be described, when locking ring 54 overlies pin connection coupling 20 movement of locking ring 54 is prevented by a tubular member 100 connected to pin connection coupling 20. Locking ring 54 is need only be friction fit into position, if it is to be held in place during use by the tubular connected to pin connection coupling 20. However, in view of a possibility of loss due to vibration during transport, it is preferred that a set screw 58 engage locking ring 54 to secure locking ring 54 to body 12.

Illustrated in FIG. 1, but not of particular relevance to the present invention are a number of further components which will now be described for the sake of completeness. Each of rotary cutters 36 have carbide buttons 60. Each of rotary cutters 36 have grease fittings 62 used for the injection of lubrication. Each of rotary cutters 36 have a pressure balancing piston 64 in a pressure balancing passage 66, which serve to balance internal pressure to external pressure. Travel of pressure balancing pistons 64 in pressure balancing passage 66 is limited by a spring pin 68. In order to prevent loss of lubricant, seals 70 are positioned at each end of rotary cutters 36. Rotary cutters 36 rotate on bearing sleeves 72. Rotary cutters 36 have washers 74, which separate rotary cutters 36 from the retainers 46 and 50.

Operation:

The use and operation of rotary cutter assembly in accordance with the teachings of the present method will now be described with reference to FIGS. 1 and 2. The objective of the present invention is to prevent loss of rotary cutter 36 down hole during use. When tool components are lost down hole, further drilling ceases while the lost components are recovered. This disruption of drilling and recovery operation can be costly. Referring to FIG. 1, it can be seen how first shoulder 30 engages first retainer 46 to limit movement in the first direction. It can also be seen how truncated second shoulder 32 engages second retainer 50 to limit movement in the second direction. The only way first retainer 46 and second retainer 50 can be removed is radially from cutter pocket 24. First retainer 46 is prevented from being removed radially from cutter pocket 24 as tongue-like projection 48 on first retainer 46 is engaged with receptacle 34 in first shoulder 30. Second retainer 50 is prevented from being removed radially from cutter pocket 24 by locking ring 54, which overlies step down portion 52 of second retainer 50. Once locking ring 54 is moved axially out of engagement with step down portion 52 of second retainer 50, the entire assembly of first retainer 46, rotary cutter 36 and second retainer 50 can be readily removed. However, this is not going to happen during use, for the connection of tubular 100 to pin connection coupling 20 eliminates any possibility of locking ring 54 moving during use. As previously described, a set screw 58 is provided to secure locking ring 54 to body 12. However, set screw 58 is not relied upon during use. It is intended merely to prevent loss of locking ring 54 due to vibration during transport.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. Method of securing a rotary cutter to a body, comprising the steps of:

forming in an exterior surface of the body a cutter pocket having a first shoulder oriented toward a first end of the body and a truncated second shoulder oriented toward a second end of the body;

forming one of at least one receptacle extending into the first shoulder or at least one projection projecting from the first shoulder;

forming a first retainer retaining a first axle end of the rotary cutter, the first retainer engaging the first shoulder of the cutter pocket to prevent axial movement in a first direction and having an other of the at least one receptacle or the at least one projection adapted to engage the at least one receptacle in or the at least one projection from the first shoulder to prevent removal of the first retainer radially from the cutter pocket;

forming a second retainer retaining a second axle end of the rotary cutter, the second retainer having a step down portion engaging the truncated second shoulder of the cutter pocket to prevent axial movement in a second direction; and positioning a locking ring on the exterior surface of the body, the locking ring overlying the truncated second shoulder and the step down portion of the second retainer to prevent removal of the second retainer radially from the cutter pocket.

2. The method as defined in claim 1, including a step of having the locking ring overlie a pin connection coupling on the body and connecting a tubular forming part of a drill string to the pin connection, such that movement of the locking ring is prevented by the tubular connected to the pin connection coupling.

3. A rotary cutter assembly, comprising:

a tubular body having a first end defining a first coupling, a second end defining a second coupling, an exterior surface defining more than one cutter pocket, an interior surface defining an interior bore;

each cutter pocket having a first shoulder oriented toward the first end of the body and a truncated second shoulder oriented toward the second end of the body, with one of at least one receptacle extending into the first shoulder or at least one projection projecting from the first shoulder;

a rotary cutter being provided for each cutter pocket, each rotary cutter having a first end oriented toward the first end of the body and a second end oriented toward the second end of the body, with a first axle end protruding from the first end and a second axle end protruding from the second end of the rotary cutter;

a first retainer retaining the first axle end of the rotary cutter, the first retainer engaging the first shoulder of the cutter pocket to prevent axial movement in a first direction and having an other of the at least one receptacle or the at least one projection adapted to engage the at least one receptacle in or the at least one projection from the first shoulder to prevent removal of the first retainer radially from the cutter pocket;

a second retainer retaining the second axle end of the rotary cutter, the second retainer having a step down portion engaging the truncated second shoulder of the cutter pocket to prevent axial movement in a second direction; and a locking ring engaging the exterior surface of the body, the locking ring overlying the truncated second shoulder and the step down portion of the second retainer to prevent removal of the second retainer radially from the cutter pocket.

4. The rotary cutter assembly as defined in claim 3, wherein a pin connection coupling is positioned at the second end of the body, and the locking ring overlies the pin connection coupling, such that during use down hole movement of the locking ring is prevented by a tubular connected to the pin connection coupling.

5. The rotary cutter assembly as defined in claim 3, wherein there is at least one receptacle in the first shoulder and at least one projection protruding from the first retainer.

6. The rotary cutter assembly as defined in claim 3, wherein a set screw engages the locking ring to secure the locking ring to the body during transport.

* * * * *